United States Patent [19]

Lange

[11] Patent Number: 4,491,221

[45] Date of Patent: Jan. 1, 1985

[54] CONVERTIBLE THREE BALL TO TWO BALL GOLF BALL CARRYING CONTAINER

[76] Inventor: Bernhardt L. Lange, 1403 Glendale St., Saginaw, Mich.

[21] Appl. No.: 507,594

[22] Filed: Jun. 24, 1983

[51] Int. Cl.[3] ..... B65D 85/00; B65D 85/58

[52] U.S. Cl. ..... 206/315.9; 206/535; 206/603; 206/623; 220/4 B; 220/8

[58] Field of Search ..... 206/315.9, 603, 38, 206/535, 623, 248; 220/4 E, 4 B, 8

[56] References Cited

U.S. PATENT DOCUMENTS

| | | | |
|---|---|---|---|
| 478,947 | 7/1892 | Ames, Jr. | 220/4 B |
| 2,145,430 | 1/1939 | New | 206/623 |
| 2,447,844 | 8/1948 | Cutter | 206/38 |
| 2,515,715 | 7/1950 | Jones | 220/4 E |
| 3,047,140 | 7/1962 | Robins | 206/315.9 |
| 3,756,299 | 9/1973 | Simmons et al. | 206/315.9 |
| 4,393,974 | 7/1983 | Leresque | 220/4 B |

FOREIGN PATENT DOCUMENTS

| | | | |
|---|---|---|---|
| 1530594 | 5/1968 | France | 220/4 E |

*Primary Examiner*—William T. Dixson, Jr.
*Assistant Examiner*—Brenda J. Ehrhardt
*Attorney, Agent, or Firm*—Learman & McCulloch

[57] ABSTRACT

A convertible three-ball to two-ball golf ball container wherein a pair of thin-wall cylindrical tubes, which are opened at adjoining ends and have semi-spherical closed opposite ends, are telescoped together and closely accommodate three or two golf balls in abutting relation.

4 Claims, 4 Drawing Figures

CONVERTIBLE THREE BALL TO TWO BALL GOLF BALL CARRYING CONTAINER

BACKGROUND OF THE INVENTION

The present invention relates to a convertible ball carrying container for golf balls which is suitable for either three or two golf balls, and permits them to be comfortably and compactly carried in the pocket of the golfer, whether the container is holding either two or three golf balls.

Prior art containers are disclosed in the following United States patents, but do not provide the readily convertible container for golf balls which is disclosed and claimed in the present application:

U.S. Pat. No. 1,919,198, Burnet
U.S. Pat. No. 3,047,140, Robins
U.S. Pat. No. 3,819,040, Coons
U.S. Pat. No. 4,296,874, Evans

SUMMARY OF THE INVENTION

It is an object of the present invention to provide a ball carrying container which avoids many of the problems and inconveniences associated with present three-ball golf ball containers which basically are of the type wherein an elongate rectangular box is provided for the three balls. The sharp corners of the box are uncomfortable in the pocket of the golfer and so he normally removes all three of the balls from the box and carries them loosely in his pockets. When removing other items from a pocket, the balls frequently will be inadvertently removed at the same time, and many golfers become annoyed with this inconvenience.

One of the prime objects of the present invention is to provide a convertible ball carrying container which comfortably accommodates two, as well as three, golf balls and is readily convertible by the golfer to achieve that purpose.

A further object of the invention is to provide a convertible container of compact nature which can be reduced in length to make a more compact package when one golf ball is removed from the container, without in any way changing the shape of the container except to compact it, and without losing any of the desirable characteristics inherent in the configuration of the container.

Still a further object of the invention is to provide a ball carrying container which may be economically constructed of thin-walled, transparent plastic tubing or the like, and assembled easily on a mass-production basis.

Still another object of the invention is to provide a container of the type described in which the telescopic sections, when in position to hold three golf balls in abutting relation, includes one section with a tear-away portion permitting the container to hold two balls in the same relationship, and a ball carrying container in which the tear-away section is protected and cannot be inadvertently destructed.

A further object of the invention is to provide a disposable two-piece container in which the product, may be marketed, which can be easily disassembled for purposes of removing a golf ball, and then as easily reassembled to form a two golf ball package.

The present convertible container solves the problems inherent in prior art containers and achieves the advantages mentioned by providing a pair of thin-walled sleeves each with an open end and a closed end, the closed ends being semi-spherical in configuration and closely accommodating golf balls placed in abutting relation within the container. One of the transparent, thin-walled tubular sections is in the form of a body and the other in the form of a cap, and the length characteristics of these members is such that the container readily converts from a three ball container to a two ball container.

Other objects and features of the invention will become apparent by reference to the following specification and to the drawings.

Figure 1:
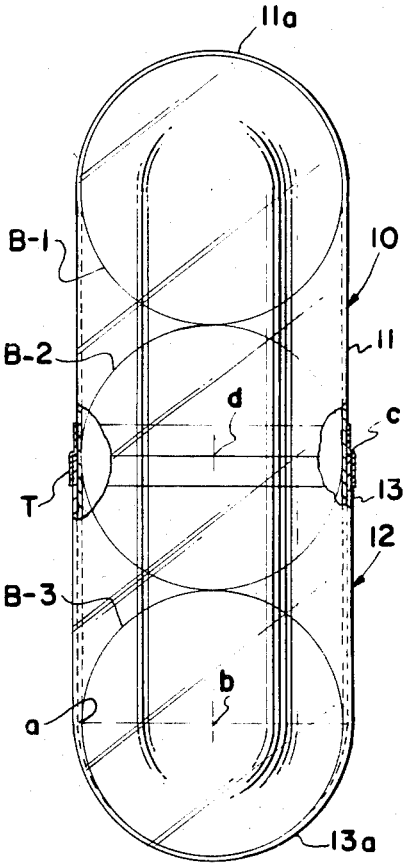
FIG. 1 is a partly sectional, side elevational view illustrating the novel convertible container.
Figure 2:
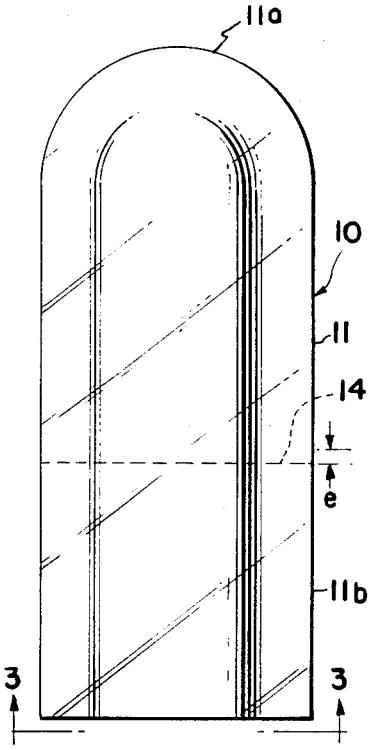
FIG. 2 is a similar view of the body thereof only.

Referring now more particularly to the accompanying drawings, in FIG. 2, I have shown the tubular body portion 10 of the container as constituting a thin-walled (i.e., 3–6 mm), somewhat rigid member which comprises a tubular cylindrical body portion 11 and a semi-spherical closed end wall portion 11*a*. A cap portion, generally designated 12, which is telescoped over the body portion 11, similarly includes a cylindrical body portion 13 and a closed semi-spherical end portion 13*a*. The balls B-1, B-2, and B-3 are in abutting relation with one another, and the end walls 11*a* and 13*a*, when the container is in the three-ball assembled relationship disclosed in FIG. 1. An adhesive plastic tape T may be optionally used to assist in the prevention of pilfering, if desired.

Both the sections 10 and 12 can be constructed of thin-walled plastic, such as polyethylene, polypropylene, and many like or similar suitable materials which are only thick enough to provide adequate rigidity when the sections 10 and 12 are being telescoped together. As FIG. 2 particularly indicates, the body portion 10 is perforated or scored as at 14 at a particular position and the plastic may therefore also be readily tearable, to permit the portion 11*b* to be torn away from the remainder of the body portion 10 when desired. As FIG. 2 indicates, the overall length of body section 10 is $2\frac{1}{2}$ ball diameters, and the overall length of cap section 12 is $1\frac{1}{2}$ ball diameters. With this relationship, as FIG. 1 indicates, the open end of body portion 11 is frictionally engaged with the lowermost ball B-3 at a point a in radial alignment with the center b of the lowermost golf ball B-3. Thus, the open end of member 11 is in frictional engagement with the lowermost golf ball and has frictional purchase with the ball around the entire circumference of the ball. Similarly, cap portion 12 is in engagement with the tubular body portion 11 of body 10, at a location c radially opposite the center d of the middle ball B-2 in FIG. 1, and thus maintains a frictional purchase around the circumference of cap 12 which is backed by the entire rigid circumference of the middle ball B-2.

As FIG. 2 discloses, the circumferential line of deformation or perforation 14, is situated a distance e, i.e. about 3 mm., beyond the "c" location, and the upper edge of cap 12 extends upwardly above, and protects, the perforation line 14 so that the container cannot be readily torn apart.

In the FIG. 4 position, with portion 11*b* torn away from the body portion 10, and the middle golf ball B-2 removed, the body 10, which is the radially inner, telescoped member, extends slightly below the center b of the ball B-3 to circumferentially frictionally engage ball B-3. The open end of the cylindrical portion 13 of cap 12 is in engagement with the body 10 at the circumferential location f at a location radially opposite the center g of ball B-1. At location f, a maximum frictional purchase between body 10 and cap 12 is achieved with the backing of rigid ball B-1.

In practice, the golf balls will be sold in the container disclosed in FIG. 1, and, to remove a ball, the user need merely, after removing tape T, grasp both ends 10 and 12 of the container and pull them apart to liberate the middle ball B-2, while holding the balls B-1 and B-3 in position. The sections 10 and 12 are then re-telescoped, after the tear-off section has been removed, to achieve the FIG. 4 position. In both instances, the compact package with rounded ends, and no protrusions, will fit comfortably within the pocket of the user, or of course, may be more compactly accommodated in the ball pocket of the golf bag.

Figure 4:
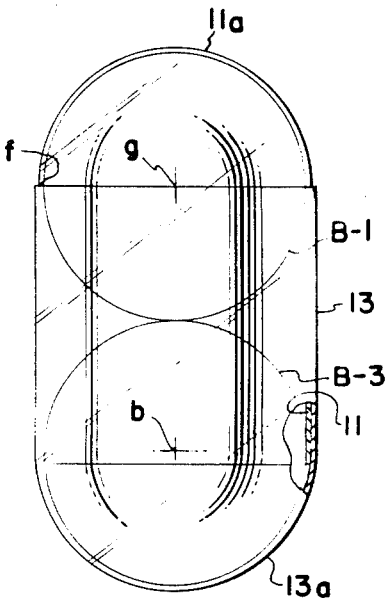
FIG. 4 is a view similar to FIG. 1 but with the container telescoped to snugly accommodate two golf balls.
Figure 3:
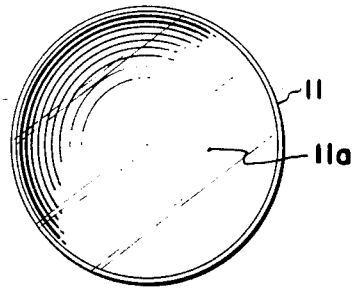
FIG. 3 is an end elevational view taken on the line 3—3 of FIG. 2.

The length of cap 12 should be such that it does not project substantially beyond the location f in the FIG. 4 position, but it should be long enough to cover the perforations 14 and extend to the circumferential location c in the FIG. 1 position to exert the maximum frictional purchase. American golf balls have a Professional Golf Association approved diameter of 1.68 inches (42.672 mm). English golf balls have an approved diameter of 1.62 inches.

It is to be understood that while one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. A convertible three ball to two ball golf ball container with Golf Association approved diameter balls comprising:

a. a first thin-walled axially extending cylindrical tube open at one end and closed at the other, the closed end having a semi-spherical configuration sized to closely accommodate a golf ball and the tube otherwise having a body portion of an internal diameter to closely accommodate the diameter of a golf ball, and a length of more than one and one-half times the ball diameter;

b. an axially shorter second thin-walled axially extending cylindrical tube open at one end and closed at the other, the closed end having a semi-spherical configuration also sized to closely accommodate a golf ball and the tube otherwise having a body portion of an internal diameter to closely accommodate a golf ball, and a length of at least one and one-half times the ball diameter; the open end of one of said tubes being telescoped over the open end of the other of said tubes;

c. three golf balls in endwisely abutting relation within said tubes substantially in contact with one another and the respective closed ends of the tubes;

d. the first tube being circumferentially scored to weaken it and provide a tear-away surface defining a tear-away portion near its open end, at a location such that the open end of the tube which is telescoped over the other tube extends to at least radially align substantially with the center of the golf ball in the closed end of the other tube to obtain full circumferential frictional purchase with the maximum girth of the ball, when the said tear-away portion is removed and the first and second tubes are telescopically compressed to closely accommodate two balls in abutting relation;

e. the open end of the second tube overlying a radial place perpendicular to the tubes passing through the center of the middle ball to obtain full circumferential purchase with the maximum girth of the middle ball.

2. The invention of claim 1 in which the length of the tube having the tear-away portion exceeds the length of the other tube by substantially a ball diameter.

3. The invention of claim 1 in which it is the tube which does not have the tear-away portion which is telescoped over the other tube and the body portion of this tube extends to cover the circumferentially deformed portion.

4. The invention of claim 3 wherein the body portion of the tube having the tear-away portion has a length equal to two times the diameter of a golf ball and the body portion of the other tube has a length slightly exceeding one and one-half times the diameter of a golf ball.

* * * * *

UNITED STATES PATENT AND TRADEMARK OFFICE

CERTIFICATE OF CORRECTION

PATENT NO. : 4,491,221

DATED : January 1, 1985

INVENTOR(S) : Bernhardt L. Lange

It is certified that error appears in the above-identified patent and that said Letters Patent are hereby corrected as shown below:

Column 4, line 31, change "place" to -- plane --.

Signed and Sealed this

*Seventh* Day of *May 1985*

[SEAL]

*Attest:*

DONALD J. QUIGG

*Attesting Officer* *Acting Commissioner of Patents and Trademarks*